United States Patent [19]

Beile et al.

[11] Patent Number: 5,052,650

[45] Date of Patent: Oct. 1, 1991

[54] COPYHOLDER

[75] Inventors: James W. Beile, Arlington Heights; Michael Jaron, Mt. Prospect, both of Ill.

[73] Assignee: Fellowes Manufacturing Company, Itasca, Ill.

[21] Appl. No.: 601,414

[22] Filed: Oct. 22, 1990

[51] Int. Cl.[5] ..... A47B 63/00

[52] U.S. Cl. ..... 248/451; 248/456; 248/465; 400/718

[58] Field of Search ..... 248/465, 442.2, 441.1, 248/456, 451, 452, 453, 454, 447.1; 400/718

[56] References Cited

U.S. PATENT DOCUMENTS

| | | | |
|---|---|---|---|
| 552,288 | 12/1895 | Henderson . | |
| 624,912 | 5/1899 | Cord | 400/718 |
| 947,614 | 1/1910 | Hopkins . | |
| 1,006,270 | 10/1911 | Planert . | |
| 1,221,369 | 4/1917 | Osborn . | |
| 1,559,366 | 10/1925 | Phelps, Jr. | 248/451 X |
| 1,580,344 | 4/1926 | Stillians | 248/456 |
| 1,615,959 | 2/1927 | Slavik . | |
| 1,723,332 | 8/1929 | Day et al. . | |
| 1,808,796 | 6/1931 | Smyth . | |
| 1,908,874 | 5/1933 | Van Alstine . | |
| 1,977,931 | 10/1934 | Woodley . | |
| 2,034,930 | 3/1936 | Van Alstyne | 248/451 X |
| 2,134,138 | 10/1938 | Manzler . | |
| 2,146,465 | 2/1939 | Coppock . | |
| 2,194,019 | 3/1940 | Hartsel | 248/451 |
| 2,239,791 | 4/1941 | Lemperle . | |
| 2,508,470 | 5/1950 | Ritter | 269/254 D X |
| 2,865,132 | 12/1958 | Fleming . | |
| 3,200,791 | 8/1965 | Swett . | |
| 4,150,807 | 4/1979 | Manso | 248/452 |
| 4,159,836 | 4/1979 | Tarr . | |
| 4,181,282 | 1/1980 | Oliver et al. . | |
| 4,582,285 | 4/1986 | Bello | 248/454 X |
| 4,620,687 | 11/1986 | Bishop . | |
| 4,702,453 | 10/1987 | Bishop . | |
| 4,747,572 | 5/1988 | Weber . | |
| 4,902,078 | 2/1990 | Judd . | |
| 4,917,343 | 4/1990 | Wawscott | 248/454 X |
| 4,934,853 | 6/1990 | King, III . | |
| 4,957,261 | 9/1990 | Cirami | 248/454 |
| 4,984,756 | 1/1990 | Jan . | |

FOREIGN PATENT DOCUMENTS

| | | | |
|---|---|---|---|
| 448283 | 3/1924 | Fed. Rep. of Germany | 248/451 |
| 179401 | 9/1935 | Fed. Rep. of Germany . | |
| 208814 | 10/1959 | Fed. Rep. of Germany | 248/451 |
| 1141301 | 12/1962 | Fed. Rep. of Germany | 400/718 |
| 316603 | 8/1929 | Norway . | |
| 11758 | of 1907 | United Kingdom . | |
| 8365 | of 1910 | United Kingdom . | |
| 2145038 | 3/1985 | United Kingdom | 400/718 |

*Primary Examiner*—David L. Talbott
*Attorney, Agent, or Firm*—Willian Brinks Olds Hofer Gilson & Lione

[57] ABSTRACT

A copyholder for holding and positioning documents. The copyholder contains a flat surface and a multi-action document holder which pivots between a horizontal position when in use, and a vertical position when not in use. The document holder pivots by a spring loaded mechanism, which locks it into the vertical and horizontal positions. The spring loaded mechanism also allows the document holder to expand and accept thick documents. The document holder also functions as a lineguide.

4 Claims, 2 Drawing Sheets

COPYHOLDER

BACKGROUND OF THE INVENTION

The present invention relates to a copyholder for positioning printed material, such as papers or books, so that a user can view the material while performing other tasks. The copyholder is useful in an office environment for secretarial, clerical, or managerial use, and is especially useful in transcribing printed material with a typewriter, word processor, or computer.

A copyholder supports documents on a flat surface, and the documents are generally held in place with a holding means, such as a bar which attaches to the copyholder and extends across the width of the documents. However, a user often wants to support the documents only and does not want to use the bar to hold them in place. In this instance, the bar interferes with the users ability to change documents and lay them on the surface because it is stretched across the flat surface. The present invention eliminates this interference by providing a means for conveniently pivoting the document holding means out of the users way when not in use.

SUMMARY OF THE INVENTION

The copyholder contains a flat surface and a ledge extending outwardly from the bottom of the surface. A multi-action holding means is slidably attached to a side of the flat surface and comprises a spring loaded pivot mechanism. The holding means holds documents in place as they rest on the flat surface and ledge, and functions as a lineguide for the user. The spring loaded mechanism allows the holding means to expand and accept thick documents, and when not in use, allows the holding means to pivot out of the way to a vertical position.

DESCRIPTION OF THE PREFERRED EMBODIMENTS

Figure 1:
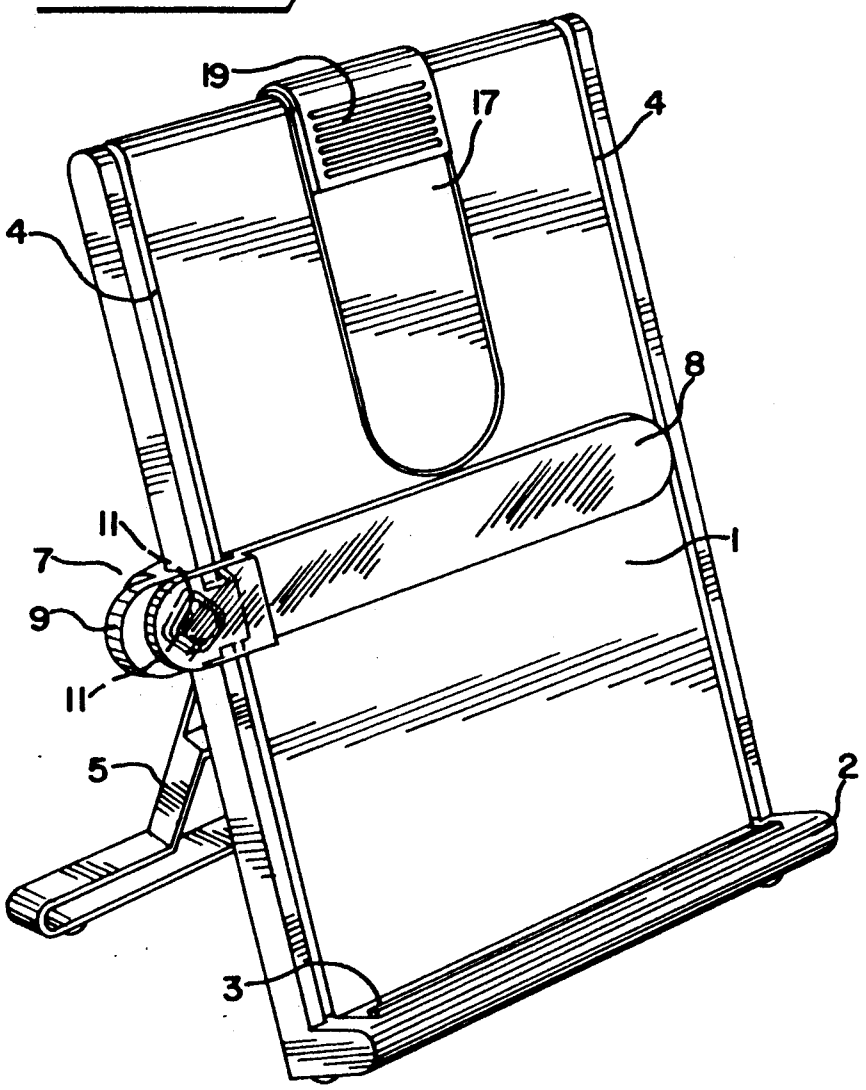
FIG. 1 illustrates an overall perspective of a copyholder of the present invention.

According to FIG. 1, the copyholder comprises a flat surface 1 and a ledge 2 which extends outwardly at approximately a right angle from the bottom of the flat surface. A support tab 3 extends upwardly from the ledge 2. Documents rest against the flat surface and are supported at the bottom by ledge 2 and tab 3. Grooves 4 are formed into both sides of the flat surface and preferably extend the length of the flat surface. The flat surface is supported by bracket 5 which tilts to multiple positions so the user can view the document at a comfortable angle. Any known bracket may be employed, but a notch-type bracket with at least five angles of adjustment, such as that shown in FIG. 2., is preferred.

Figure 2:
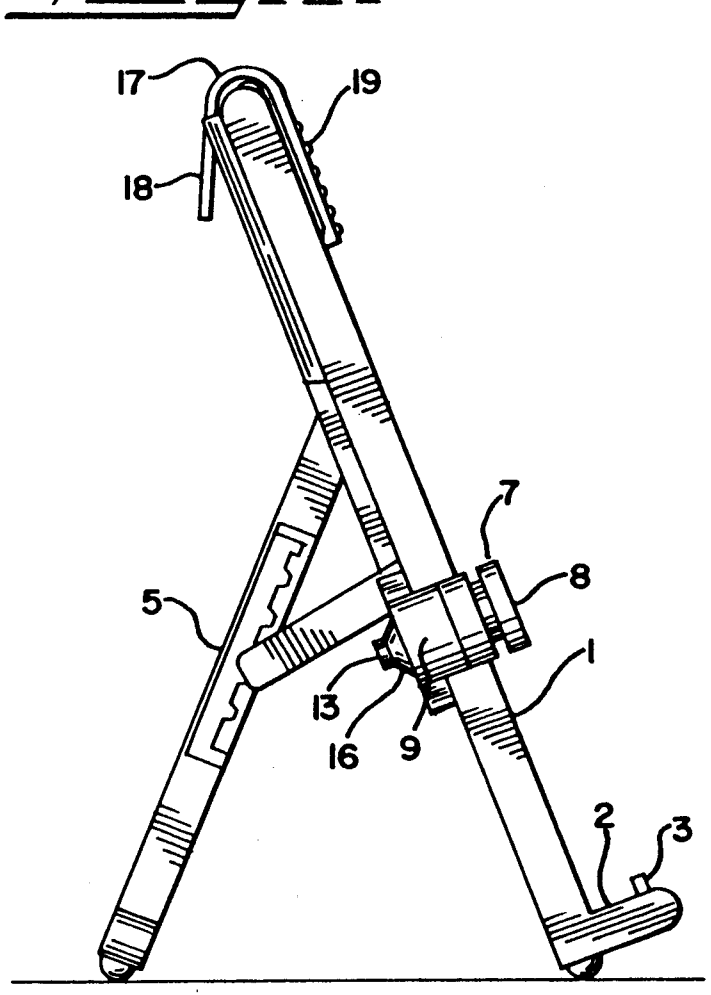
FIG. 2 illustrates a side perspective of a copyholder of the present invention.
Figure 3:
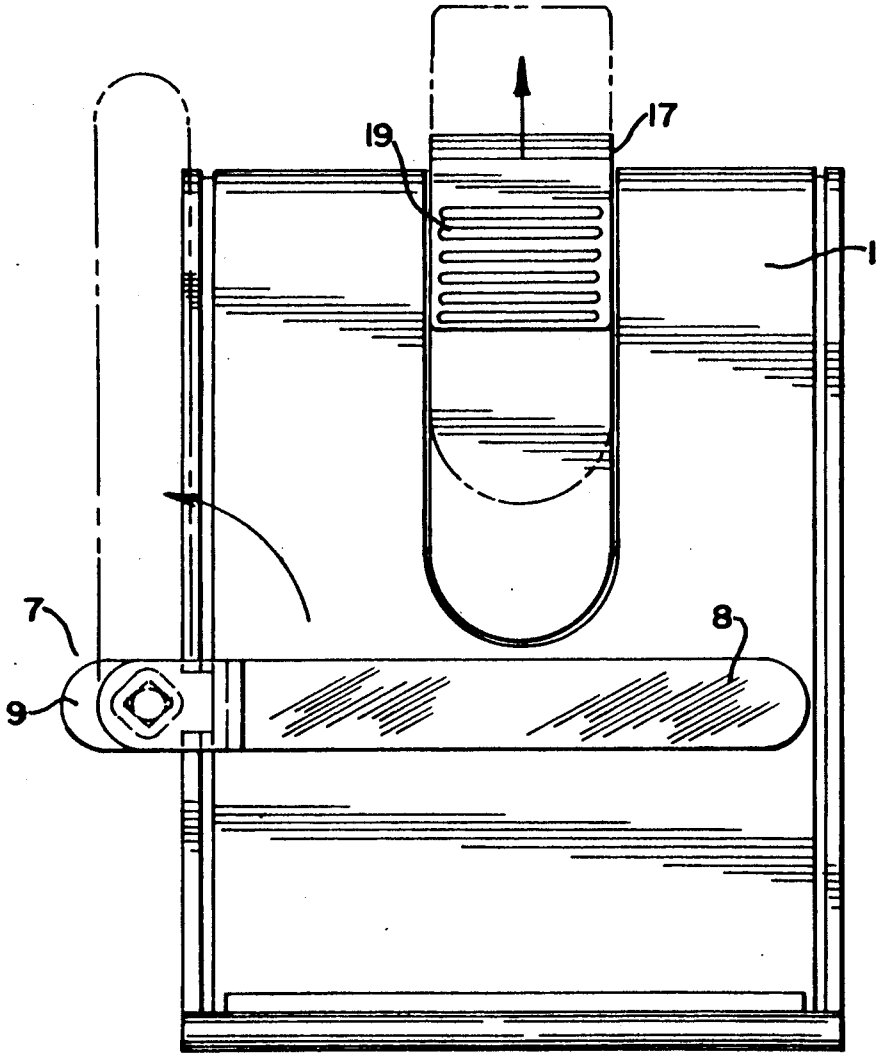
FIG. 3 illustrates a front perspective of a copyholder of the present invention.

A clip 17 located at the top of the flat surface holds the top of the document in place, and may be extended upwards, as shown in FIG. 3, to hold various sized paper, including letter, A/4, and legal sizes. While any suitable clip may be used, the clip 17 shown in the drawings is preferred. Clip 17 is a spring action one-touch clip which easily releases a document from the flat surface 1 when a contoured tab 18 located behind the flat surface is pressed inwardly towards the back (FIG. 2). Ridges or grooves 19 may also be provided at appropriate locations to help the user raise and lower the clip 17 (FIG. 3).

A document holder 7 slidably attaches to either side of the flat surface by fitting into one of the grooves 4. The document holder 7 comprises a lineguide 8 and a housing 9. The lineguide is preferably constructed of a clear plastic material to allow printed matter to show through, and may highlight portions of the document with a thin line or by magnification.

Figure 4:
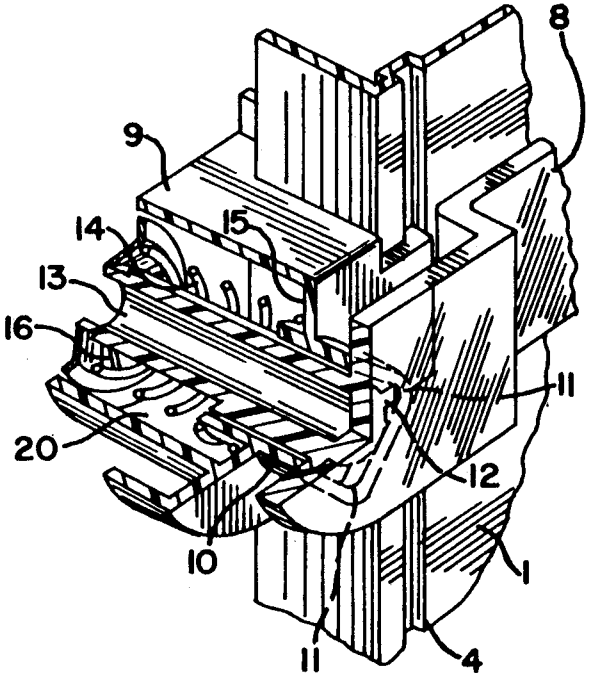
FIG. 4 illustrates a broken away perspective of the holding means and spring loaded pivot mechanism of the present invention.

FIG. 4 illustrates the spring loaded pivot mechanism embodiment of the present invention. The housing 9 is open at both ends, and contains a lower hollow portion 20 and an upper open-ended square-shaped chamber 10. The lower hollow portion 20 may be any shape that will allow the user to easily grab and slide the document holder 7 up and down the flat surface 1. Preferably, the lower hollow portion 20 has a lower curved C-shaped surface and an upper curved C-shaped surface which is larger and thereby forms a tab.

The square-shaped chamber 10 is set partially into and extends above the hollow portion 20. The chamber 10 contains grooves 11 for receiving tabs 12 located on a pin 13 which extends from one end of the lineguide 8. While the chamber 10 preferably extends into and out of the lower hollow portion 20, it may also be set substantially into or out of the hollow portion 20. Also, while the chamber 10 is preferably square, it may be any shape which will allow the pin 13 to pass through.

According to the preferred embodiment, the grooves are located at the four inside corners and extend the length of the square-shaped chamber 10. Two tabs 12 extend radially from the pin 13 and opposite one another. (FIG. 4 shows only one tab 12.) The tabs 12 extend down the pin 13 a length sufficient to fit into any opposing pair of grooves 11 and preferably are longer than the length of the grooves 11. A coiled spring 14 is wound about and secures pin 13 to the housing 9. The spring 14 abuts shoulder 15 at the top of the hollow portion 20, and abuts lock washer 16 affixed near the bottom of pin 13.

The pivot mechanism, is in a locked position when the tabs 12 are engaged with grooves 11. A user releases the pivot mechanism from the locked position by forcing the pin 13, which is under the tension of the coil spring 14, upwards from the bottom through the hollow portion 20 and chamber 10. As the pin is forced upwards, the tabs 12 slide upwardly out of grooves 11 and disengage the grooves at the top. When completely disengaged, pin 13 may be freely pivoted within the hollow portion 20 and chamber 10. Thus, the document holder 7 may be easily locked into a horizontal position when in use, and disengaged, pivoted, and then locked into a vertical position when not in use.

The spring loaded pivot mechanism also allows the document holder 7 to expand and accept thick documents. For example, when locked in the horizontal position, the lineguide 8 may be moved outwardly away from the flat surface 1, but will remain locked as long as tabs 12 are engaged with grooves 11. The dimensions of the mechanism will preferably allow the document holder 7 to hold documents up to one-half inch thick, but the mechanism can be used to hold any reasonable thickness. The documents are held in place by the force exerted from the coil spring that is transferred to lineguide 8. The lineguide 8 extends substantially across the width of the flat surface 1, and forces the documents the front of the flat surface 1.

It is to be understood that while the above embodiments are preferred they are not limitations of the invention. Thus, changes, modifications, and substitutions to the preferred embodiments which are consistent with the invention described in the claims are also contemplated.

What is claimed is:

1. A copyholder comprising:

a) a flat surface;

b) a ledge extending outwardly from the bottom of said flat surface;

c) an open ended housing slidably attached to one side of the flat surface, said housing having a lower hollow portion, the top of said lower hollow portion defining an internal top shoulder forming an aperture surrounded by said shoulder, said aperture having a center axis which is perpendicular to the flat surface and having internal grooves extending perpendicular to the flat surface;

d) a document holder having a pin at one end extending into said aperture and a bar extending perpendicular from the pin;

e) at least one tab radially extending from said pin and adapted to fit into any one of the internal grooves in said aperture;

f) a lock washer affixed near the distal end of said pin; and g) a coil spring wound about said pin and abutting the inside shoulder of said housing at the top and the lock washer at the bottom.

2. The copyholder of claim 1 further comprising an extendable clip attached to the top of said flat surface.

3. The copyholder of claim 1 further comprising a tiltable supporting bracket attached to the back side of said flat surface.

4. The copyholder of claim 1 wherein the bar extends a length sufficient to substantially traverse the width of the flat surface.

* * * * *

UNITED STATES PATENT AND TRADEMARK OFFICE

CERTIFICATE OF CORRECTION

PATENT NO. : 5,052,650

DATED : October 1, 1991

INVENTOR(S) : James W. Beile et al.

It is certified that error appears in the above-identified patent and that said Letters Patent is hereby corrected as shown below:

On the title page: Item [56]

IN THE REFERENCES CITED

On page 1, column 2, on the line following "4,957,261 9/1990 Cirami.....248/454" please insert --4,960,257 10/1990 Waters--.

On page 1, column 2, under the heading "FOREIGN PATENT DOCUMENTS," after "11758" please delete "of 1907" and substitute therefor --5/1907--; after "8365" please delete "of 1910" and substitute therefor --1/1910--.

In column 1, line 58, after "surface" please insert --1--; line 65, after "surface" insert --1--.

In column 2, line 10, after "surface" please insert --1--.

In column 2, line 35, after "grooves" please insert --11--.

UNITED STATES PATENT AND TRADEMARK OFFICE

CERTIFICATE OF CORRECTION

PATENT NO. : 5,052,650

DATED : October 1, 1991

INVENTOR(S) : James W. Beile et al.

It is certified that error appears in the above-identified patent and that said Letters Patent is hereby corrected as shown below:

In column 3, line 3, after "spring" please insert --14--.

Signed and Sealed this

Sixteenth Day of November, 1993

Attest:

Bruce Lehman

BRUCE LEHMAN

Attesting Officer

Commissioner of Patents and Trademarks